United States Patent [19]

Cordova et al.

[11] Patent Number: 4,879,179

[45] Date of Patent: Nov. 7, 1989

[54] ORGANIC REINFORCING FIBERS WITH BUNDLE SEPARATION DURING FIBER CUTTING

[75] Inventors: David S. Cordova, Midlothian, Va.; Hugh H. Rowan, Chapel Hill, N.C.; John A. Young, Chester, Va.

[73] Assignee: Allied-Signal Inc., Morris Township, Morris County, N.J.

[21] Appl. No.: 900,925

[22] Filed: Aug. 27, 1986

[51] Int. Cl.[4] ..... D02G 3/00

[52] U.S. Cl. ..... 428/361; 428/372; 428/380; 428/383; 428/389; 428/394; 428/395; 428/400

[58] Field of Search ..... 428/372, 375, 379, 380, 428/389, 394, 395, 400, 361; 57/8, 258, 243, 252, 257

[56] References Cited

U.S. PATENT DOCUMENTS

| | | | |
|---|---|---|---|
| 2,805,959 | 9/1957 | Ewing | 428/361 |
| 3,579,409 | 5/1971 | Shannon | 428/372 |
| 4,268,645 | 5/1981 | Lark | 428/395 |
| 4,296,174 | 10/1981 | Hanzel et al. | 428/394 |

*Primary Examiner*—Lorraine T. Kendell

[57] ABSTRACT

A high tenacity, high elongation, low shrinkage synthetic fiber is treated to enhance stiffness and interfilament coherency, then dusted with a release agent, resulting in a fiber, combined in multiple high denier bundles, which can be cut at high speed to suitable reinforcing lengths for use in reinforcing a resin matrix. The cut fiber can be used in bulk molding compounds (BMC), sheet molding compounds (TMC) and spray-up applications due to ease of cutting.

15 Claims, No Drawings

ORGANIC REINFORCING FIBERS WITH BUNDLE SEPARATION DURING FIBER CUTTING

BACKGROUND OF THE INVENTION

1. Field of the Invention

The present invention relates to a high tenacity, high elongation, low shrinkage synthetic fiber treated to enhance stiffness and interfilament coherency, then dusted with a partitioning agent. The resulting fiber, combined in multiple high denier bundles, can be cut at high speed to suitable reinforcing lengths for use in reinforcing a resin matrix. The cut fiber can be used in bulk molding compounds (BMC), sheet molding compounds (SMC) and spray-up applications due to ease of cutting.

2. Description of Related Art

Synthetic fibers in staple or filamentary form, and fabrics produced therefrom, are known for polymer reinforcement. Typical of the fibrous reinforcements are glass, polyester, polyamide (nylon and aramid) and polyolefin fibers. Conventional matrix resins include thermoplastics, such as nylon and polyolefins, and thermosetting materials, such as epoxy and unsaturated polyester resins. Since the primary function of the interface between fiber and matrix is to transmit stress from the matrix to the reinforcing fibers, the chemical and physical features of the interface are critical to the mechanical properties ad end use performance of the composite. The compatibility between the reinforcing fiber and matrix is then a determining factor in the load sharing ability of the composite.

Fiber coatings/binders have been used to enhance the compatability of the reinforcing fibers and resins with which they are to be used.

Fiber bundle integrity is the degree to which individual filaments adhere to each other. Polyester fiber, for example, inherently has a low fiber bundle integrity. A benefit of a low integrity fiber is that it enables good dispersion of single filaments throughout a resin matrix. This even distribution results in a homogeneous reinforced composite, a direct result of which is an improved cosmetic appearance. However, in operations where high speed cutting, on the order of from 100 to 500 feet per minute (about 30 to 150 meters per minute) or higher, of the fiber is required, e.g., SMC's and spray-up, a low integrity fiber tends to fluff or cotton ball and jam up the cutter. A high integrity yarn that is readily cut at high speed, that does not ball-up within the reinforced composite, an that provides individual bundle separation is therefore desirable. U.S. patent application Ser. No. 631,978 filed July 18, 1984, discloses a high tenacity reinforcing fiber with high bundle integrity which is treated with a composition comprising an aqueous solution of carboxyl-terminated, oil-free alkyd resin based on aliphatic glycol or a glycol ether containing 2 to 12 carbon with a combination of aromatic di- or trifunctional carboxylic acids, and optionally, unsaturated aliphatic acids. These alkyd resins are polymerized below their gel points, that is the degree of esterification is generally maintained below about 90 percent. Bundle integrity is increased while retaining compatibility of the reinforcing fiber with the resin.

In addition to advantages in high speed cutting, a fiber with high bundle integrity offers advantages in those applications in which it is preferred that the bundle of filaments remain coherent in the resin matrix rather than to disperse into single filaments. A finish such as that discussed above in U.S. patent application Ser. No. 631,978 serves to increase bundle integrity which is preserved when the cut fiber is mixed with resin matrix. However, the finish required for bundle integrity can create storage problems for the reinforcing fiber. If several ends of multifilament yarn are combined, then rolled into a package, pressure during storage may be sufficient to cause the several ends to adhere together, creating problems in the separation of these ends into individual bundles. For instance, filaments from a first end may adhere too tightly to a second end and peel away from the first end when the second end is separated. Such "ribboning" is undesirable. Another example of "ribboning" would occur during unwinding, when individual filaments from beneath may adhere to the layer being unwound, causing entanglements which can result in breaking of the fiber. Also, if the multifilament yarn is first cut to reinforcing lengths, then packed and stored, the pressure during storage may cause the individual cut bundles to "clump" together, creating problems when the cut fiber is mixed into the resin matrix.

Thus, the need exists for synthetic fiber for reinforcing plastic composites, said fiber having high bundle integrity to permit high speed cutting and unwinding ad to permit inclusion of a coherent bundle of filaments into the resin matrix, yet providing sufficient properties that the individual bundles of filaments do not adhere to each other.

SUMMARY OF THE INVENTION

Synthetic multifilament yarn selected from the group consisting of polyester, polyamide, aramid and olefin, for reinforcement of plastic composites, said yarn having been treated with a composition to enhance stiffness of the yarn for cutting and interfilament coherency and having deposited on the outer surface of the yarn 0.1 to 1.0 weight percent, based on weight of the yarn, of a partitioning agent selected from the group consisting of talc, alumina trihydrate, calcium carbonate, polyolefin powder or granules and a metallic soap selected from the group consisting of calcium stearate, zinc stearate, lead stearate, magnesium stearate, and aluminum stearate.

DETAILED DESCRIPTION OF THE INVENTION

Synthetic multifilament yarn is treated with a finish composition to enhance stiffness and interfilament coherency. The treated yarn is dusted with a powdered partitioning material such as talc or a metallic stearate. Multiple yarn ends can then be combined to produce a package of yarn ends suitable for feeding to high speed cutting apparatus to be cut into desired reinforcing length for reinforcing plastic composites.

The synthetic multifilament yarn suitable for reinforcing plastic composites are preferably high tenacity, high elongation, low shrinkage yarns selected from the group consisting of polyester, aliphatic polyamide, aramid, and polyolefin.

Examples of reinforcing polyester fiber include the linear terephthalate polyesters, i.e., polyesters of a glycol containing from 2 to 20 carbon atoms and a dicarboxylic acid component containing at least about 75 percent terephthalic acid. The remainder, if any, of the dicarboxylic acid component may be any suitable dicarboxylic acid such as sebacic acid, adipic acid, isophthalic acid, sulfonyl-4,4'-dibenzoic acid, 2,8-dibenzofuran-dicarboxylic acid, or 2,6-naphthalene dicarboxylic acid. The glycols may contain more than two carbon atoms in the chain, e.g., diethylene glycol, butylene glycol, decamethylene glycol, and bis-(1,4-hydroxylmethyl)cyclohexane. Examples of linear terephthalate polyesters which may be employed include polyethylene terephthalate, polyethylene terephthalate/5-chloroisophthalate (85/15), polyethylene terephthalate/5-sodium sulfoisophthalate (97/3), polycyclohexane-1,4-dimethylene terephthalate, and polycyclohexane-1,4-dimethylene terephthalate/hexahydroterephthalate (75/25). Examples also include liquid crystal forming highly aromatic polyesters as taught in U.S. Pat. Nos. 3,975,487; 4,083,829; and 4,285,852 and in W. J. Jackson and H. F. Kuhfuss, J. Poly. Sci. 14,2043 (1976).

Suitable reinforcing polyamides include, for example, those prepared by condensation of hexamethylene diamine and adipic acid, condensation of hexamethylene diamine and sebacic acid, condensation of butylene diamine and adipic acid known as nylon 6,6, nylon 6,10, and nylon 4,6, respectively, condensation of bis(para-aminocyclohexyl)methane and dodacanedioic acid, or by polymerization of 6-caprolactam, 7-aminoheptanoic acid, 8-caprylactam, 9-aminopelargonic acid, 11-aminoundecanoic acid, and 12-dodecalactam, known as nylon 6, nylon 7, nylon 8, nylon 9, nylon 11, and nylon 12, respectively.

A preferred polyester reinforcing fiber is polyethylene terephthalate, characterized by a thermal shrinkage of up to about 11 percent, preferably 3 percent or less; a modulus after cure of at least about 60, preferably 70 to 90 grams per denier; and a tenacity of at least 5.5, preferably at least 7 grams per denier. By modulus after cure is meant the modulus of the fiber after exposure in an unconstrained state to curing temperatures for the composite.

A preferred polyamide reinforcing fiber is a high tenacity aliphatic polyamide fiber characterized by a drawn denier of 2 to 8 denier per filament, a thermal shrinkage of up to about 14 percent, an elongation of less than 28 percent, and a tenacity of at least 5.5, preferably at least 7 grams per denier.

The synthetic multifilament yarn of this invention is treated with a finish composition to increase fiber bundle integrity and to increase stiffness. This is essential to the invention to provide a yarn that is readily cut at high speed and which does not ball-up within the reinforced composite. A high integrity yarn, cut to a desired reinforcing length, can be added to the resin matrix and the individual filament bundles within the cut yarn will retain some degree of coherency within the resin matrix.

An example of a suitable finish composition is disclosed in U.S. patent application Ser. No. 631,978 filed July 18, 1984, discussed above and incorporated herein by reference.

The finish composition is preferably applied as an overfinish to drawn yarn. The finish is applied in known ways in an amount sufficient to yield enhanced stiffness and fiber bundle integrity preferably at least about 1 weight percent solids pickup, more preferably from 3 to 6 weight percent. After finish composition is applied, the yarn is dried, for example by passing through a forced hot air heat chamber.

After drying and prior to packaging the finished yarn, it is essential to apply to the surface of the treated yarn a sufficient amount of a partitioning agent selected from the group consisting of talc, alumina trihydrate, calcium carbonate, polyolefin powder or granules, and metallic soaps.

Metallic soaps are a group of water-insoluble compounds containing alkaline earth or heavy metals combined with monobasic carboxylic acids of 7 to 22 carbon atoms. These metal salts of fatty acids and primarily of stearic acid have acquired an important industrial position as release agents. A preferred class are the stearates including calcium stearate, zinc stearate, lead stearate, magnesium stearate, and aluminum stearate. Calcium stearate is particularly preferred.

The inert particulate partitioning material is applied to the surface of the yarn preferably in a dusting operation, alternatively as a suspension in an inert volatile solvent, at an amount of 0.1 to 1.0 weight percent on the yarn. Multiple strands, or ends, of yarn so treated can then be combined to create a desired package. For example 11 ends of 1000 denier 192 filament yarn that has been treated with the lubricant powder can be combined to form 11 individual 192 filament bundles, then packaged for shipment. This 11000 denier package can be unwound and fed to high speed cutting apparatus with no sticking and ribboning problems, which cuts the fiber to desired reinforcing length. As a result of this invention, even after exposure to pressure and temperature encountered during storage, the 11000 denier package can be cut to desired lengths that break into 1000 denier/192 filament fiber bundles rather than into individual filaments. Also, when yarn so treated is cut into suitable reinforcing lengths, and these cut lengths are packaged, even after periods of storage with exposure to heat and pressure the cut lengths readily separate into the fiber bundles, and problems from the cut fiber bundles clumping together are avoided.

EXAMPLE

A high tenacity, high elongation, low shrinkage polyester yarn, commercially available from Allied Corporation as 1W72 was removed from a supply package and passed over a kiss roll applicator for application of a finish composition to achieve 5 percent pickup. The finish composition consisted of a 50/50 ammonium/sodium salt solution of the condensation polymer consisting of 49.8 moles of diethylene glycol in conjunction with 21.3 moles of isophthalic acid, 21.4 moles of terephthalic acid and 7.5 moles of trimellitic anhydride. The yarn was then passed through a 20-kilowatt microwave oven (Radio Frequency Company) for about 0.1 to 0.2 second and was taken up on a winder.

The yarn was cut into ½ inch (1.3 cm) reinforcing lengths.

Two hundred and fifty grams of the ½ inch (1.3 cm) treated yarn was placed in a plastic bag with 3 grams of talc, then shaken vigorously to disperse the powder. A second sample was prepared in a similar manner with 12 grams of alumina trihydrate. A third sample was prepared in a similar manner with 9 grams of calcium carbonate. The three 250 gram samples and a 250 gram sample of the treated yarn that had not been dusted with a powder (control) were each placed under a 10 lb. (4.5 kg) weight for 6 days, then observed for clumping. Results are given in Table I below.

TABLE I

| Powder | Powder Weight (gm) | 1W71 Fiberweight (gm) | Clumping Observed |
|---|---|---|---|
| Control | 0 | 250 | High |
| Talc | 3 | 250 | None |
| Alumina Trihydrate | 12 | 250 | Slight to Some |
| Calcium Carbonate | 9 | 250 | Medium |

Each of the samples were then compounded with unsaturated polyester resin, molded into plaques, and the resulting composites tested for tensile strength, flexural strength, notched impact strength, and unnotched impact strength. No decline in properties resulted from the presence of any of the powders.

What is claimed is:

1. Synthetic multifilament yarn selected from the group consisting of polyester, aliphatic polyamide, aramid and olefin, for reinforcement of plastic composites, said yarn having been coated with a composition to enhance stiffness of the yarn for cutting and interfilament coherency and having deposited on the outer surface of the yarn 0.1 to 1.0 weight percent, based on weight of the yarn, of a partitioning agent selected from the group consisting of talc, alumina trihydrate, calcium carbonate, polyolefin powder or granules, and a metallic soap selected from the group consisting of calcium stearate, zinc stearate, lead stearate, magnesium stearate, and aluminum stearate, wherein said composition to enhance stiffness and interfilament coherency comprises an aqueous solution of carboxyl-terminated, oil-free alkyd resin based on aliphatic glycol or a glycol ether containing 2 to 12 carbon or carbon plus ether oxygen with a combination of aromatic di- or trifunctional carboxylic acids, said resins having a degree of esterification below the gel point of the resins.

2. The yarn of claim 1 which is polyester.

3. The yarn of claim 2 which is polyethylene terephthalate having a thermal shrinkage up to about 11 percent, a modulus after cure of at least about 60 grams per denier, and a tenacity of at least 5.5 grams per denier.

4. The yarn of claim 3 wherein said partitioning agent is selected from the group consisting of talc and calcium stearate.

5. The yarn of claim 3 wherein the aliphatic glycol is selected from the group consisting of ethylene glycol, diethylene glycol, triethylene glycol, propylene glycol, tetraethylene glycol, butane diol, butene diol, butyne diol, and combinations thereof; and wherein the aromatic carboxylic acid is selected from the group consisting of orthophthalic acid, orthophthalic anhydride, isophthalic acid, terephthalic acid, trimelitic acid, trimellitic anhydride, 2,6-naphthalene dicarboxylic acid, phenylindane dicarboxylic acid, trimesic acid, 4,4'-diphenyldicarboxylic acid, 2,6-pyridine dicarboxylic acid, p-hydroxymethyl benzoic acid, 5-tert-butyl isophthalic acid, bimesitylene-4,4'-dicarboxylic acid, and combinations thereof.

6. The yarn of claim 5 wherein said yarn is treated with a sufficient amount of the composition to achieve at least about 1 percent solids pickup, wherein the aliphatic glycol is diethylene glycol and wherein the aromatic carboxylic acids are isophthalic acid, terephthalic acid and trimellitic anhydride.

7. The yarn of claim 6 wherein the solids pickup is about 3 to 6 weight percent, wherein the solution consists essentially of a salt solution of the condensation polymer consisting essentially of about 45 to 55 moles of diethylene glycol in conjunction with about 15 to 25 moles of isophthalic acid, about 15 to 25 moles of terephthalic acid and about 5 to 10 moles of trimellitic anhydride.

8. The yarn of claim 7 wherein said partitioning agent is selected from the group consisting of talc, calcium carbonate, and calcium stearate.

9. The yarn of claim 5 wherein the yarn is treated with a sufficient amount of the composition to achieve at least about 1 weight percent solids pickup, wherein the aliphatic glycols are a combination of diethylene glycol and propylene glycol, and wherein the aromatic carboxylic acids are isophthalic acid, terephthalic acid, and trimellitic anhydride, and wherein said combination of carboxylic acids additionally comprises maieic anhydride.

10. The yarn of claim 9 wherein said partitioning agent is selected from the group consisting of talc, calcium carbonate, and calcium stearate.

11. The yarn of claim 5 wherein the yarn is treated with a sufficient amount of the composition to achieve at least about 1 weight.percent solids pickup, wherein the aliphatic glycol is diethylene glycol, and wherein the aromatic carboxylic acids are isophthalic acid and trimellitic anhydride.

12. The yarn of claim 11 wherein said partitioning agent is selected from the group consisting of talc, calcium carbonate, and calcium stearate.

13. The yarn of claim 5 wherein the yarn is treated with a sufficient amount of the composition to achieve at least about 1 weight percent solids pickup, wherein the aliphatic glycol is propylene glycol, and wherein the aromatic carboxylic acids are isophthalic acid and trimellitic anhydride, and wherein said combination of carboxylic acids additionally comprises maleic anhydride.

14. The yarn of claim 13 wherein said partitioning agent is selected from the group consisting of talc, calcium carbonate, and calcium stearate.

15. The yarn of claim 3 which has been cut into reinforcing staple lengths of 1 inch or less.

* * * * *